US011352821B2

(12) United States Patent
Kellum

(10) Patent No.: US 11,352,821 B2
(45) Date of Patent: Jun. 7, 2022

(54) INVERTED CONSTANT FORCE WINDOW BALANCE HAVING SLIDABLE COIL HOUSING

(71) Applicant: Amesbury Group, Inc., Amesbury, MA (US)

(72) Inventor: Wilbur J. Kellum, Garretson, SD (US)

(73) Assignee: Amesbury Group, Inc., Edina, MN (US)

( * ) Notice: Subject to any disclaimer, the term of this patent is extended or adjusted under 35 U.S.C. 154(b) by 130 days.

(21) Appl. No.: 16/731,286

(22) Filed: Dec. 31, 2019

(65) Prior Publication Data

US 2020/0217116 A1 Jul. 9, 2020

Related U.S. Application Data

(60) Provisional application No. 62/790,210, filed on Jan. 9, 2019.

(51) Int. Cl.
*E05F 1/00* (2006.01)
*E05D 13/00* (2006.01)
(Continued)

(52) U.S. Cl.
CPC ..... *E05D 13/12* (2013.01); *E05D 15/22* (2013.01); *E05D 15/582* (2013.01);
(Continued)

(58) Field of Classification Search
CPC ..... E05D 15/22; E05D 13/1253; E05D 13/12; E05D 15/582; E05Y 2600/45;
(Continued)

(56) References Cited

U.S. PATENT DOCUMENTS 698,168 A 4/1902 Barnum
887,968 A 5/1908 Selkirk
(Continued)

FOREIGN PATENT DOCUMENTS

CA 1155341 10/1983
CA 2119506 10/1994
(Continued)

OTHER PUBLICATIONS

"Request for Ex Parte Reexamination of U.S. Pat. No. 9,133,656 Pursuant to 37 CFR 1.510 et seq", in U.S. Appl. No. 13/081,089, entitled *Inverted Constant Force Window Balance for Tilt Sash*, filed Feb. 26, 2016, 19 pgs.
(Continued)

*Primary Examiner* — Jerry E Redman
(74) *Attorney, Agent, or Firm* — Merchant & Gould P.C.

(57) ABSTRACT

An inverted constant force window balance system has a carrier assembly including a housing with a first and a second housing wall, a coil spring with a free end, and a shoe assembly slidably coupled to the housing. The shoe assembly includes a first and a second shoe face. The housing slides between a first and a second position relative to the shoe assembly. When in the first position, the first and second housing walls are substantially non-coplanar with the first shoe face, and when in the second position, the first housing wall is substantially coplanar with the first shoe face and substantially non-coplanar with the second shoe face. The shoe assembly receives a pivot bar from a window sash and extends a brake upon rotation thereof. The balance system also includes a mounting bracket releasably coupled to the housing and coupled to the free end of the coil spring.

12 Claims, 11 Drawing Sheets

(51) Int. Cl.
*E05D 15/22* (2006.01)
*E05D 15/58* (2006.01)

(52) U.S. Cl.
CPC ..... *E05Y 2201/416* (2013.01); *E05Y 2600/45* (2013.01); *E05Y 2600/51* (2013.01); *E05Y 2600/632* (2013.01); *E05Y 2900/148* (2013.01)

(58) Field of Classification Search
CPC ..... E05Y 2600/51; E05Y 2900/148; E05Y 2600/632; E05Y 2201/416
USPC ..... 49/445, 447; 411/410
See application file for complete search history.

(56) References Cited

U.S. PATENT DOCUMENTS 1,007,212 A 10/1911 Lasersohn
1,420,503 A 6/1922 Throne
1,480,453 A 1/1924 Lane
2,069,025 A 1/1937 Anderson
2,178,533 A 10/1939 Viehweger
2,209,293 A 7/1940 Cannon et al.
2,602,958 A 7/1952 Brown
2,609,191 A 9/1952 Foster
2,609,193 A 9/1952 Foster
2,622,267 A 12/1952 Peremi
2,635,282 A 4/1953 Trammell, Sr. et al.
2,644,193 A 7/1953 Anderberg
2,684,499 A 7/1954 Lewis
2,732,594 A 1/1956 Adams et al.
2,739,344 A 3/1956 Dickinson
2,766,492 A 10/1956 Day et al.
2,807,045 A 9/1957 Chenoweth
2,817,872 A 12/1957 Foster
2,851,721 A 9/1958 Decker et al.
2,873,472 A 2/1959 Foster
2,952,884 A 9/1960 Dinsmore
3,007,194 A 11/1961 Griswold
3,105,576 A 10/1963 Jones et al.
3,150,420 A 9/1964 Brenner
3,184,784 A 5/1965 Peters
3,364,622 A 1/1968 Collard
3,434,236 A 3/1969 Weidner et al.
3,445,964 A 5/1969 Foster
3,452,480 A 7/1969 Foster
3,461,608 A 8/1969 Johnson
3,475,865 A 11/1969 Ames
3,497,999 A 3/1970 Hendra
3,529,381 A 9/1970 Grossman
3,676,956 A 7/1972 Taylor et al.
3,732,594 A 5/1973 Mills
3,820,193 A 6/1974 Foster
3,844,066 A 10/1974 Nobes
3,869,754 A 3/1975 Foster
3,992,751 A 11/1976 Foster et al.
4,028,849 A 6/1977 Anderson
4,068,406 A 1/1978 Wood
4,079,549 A 3/1978 Wood
4,089,085 A 5/1978 Fitzgibbon
4,190,930 A 3/1980 Prosser
4,227,345 A 10/1980 Durham, Jr.
4,228,620 A 10/1980 Hutchins
4,300,316 A 11/1981 Ficurilli
4,332,054 A 6/1982 Paist et al.
4,364,199 A 12/1982 Johnson et al.
4,446,654 A 5/1984 Schoolman et al.
4,452,012 A 6/1984 Deal
4,506,478 A 3/1985 Anderson
4,510,713 A 4/1985 Anderson
4,517,766 A 5/1985 Haltof
4,555,868 A 12/1985 Mancuso
4,570,382 A 2/1986 Suess
4,571,887 A 2/1986 Haltof
4,590,708 A 5/1986 Campodonico
4,610,108 A 9/1986 Marshik
4,642,845 A 2/1987 Marshik
4,683,676 A 8/1987 Sterner, Jr.
4,689,850 A 9/1987 Flight
4,697,304 A 10/1987 Overgard
4,704,821 A 11/1987 Berndt
4,718,194 A * 1/1988 FitzGibbon ..... E05D 13/1207 49/181
4,785,581 A 11/1988 Abramson et al.
4,799,333 A 1/1989 Westfall et al.
4,837,976 A 6/1989 Westfall et al.
4,854,077 A 8/1989 Rogers et al.
4,885,871 A 12/1989 Westfall et al.
4,888,915 A 12/1989 Goldenberg
4,914,861 A 4/1990 May
4,922,657 A 5/1990 Foss
4,930,254 A 6/1990 Valentin
4,935,987 A 6/1990 Sterner, Jr.
4,941,285 A * 7/1990 Westfall ..... E05D 15/18 49/176
4,949,425 A 8/1990 Dodson et al.
4,953,258 A 9/1990 Mennuto
4,958,462 A 9/1990 Cross
4,961,247 A 10/1990 Leitzel et al.
5,035,081 A 7/1991 Yamamoto et al.
5,036,621 A 8/1991 Iwasaki
5,069,001 A 12/1991 Makarowski
5,113,922 A 5/1992 Christensen et al.
5,119,591 A 6/1992 Sterner, Jr. et al.
5,119,592 A 6/1992 Westfall et al.
5,127,192 A 7/1992 Cross
5,140,769 A 8/1992 Hickson et al.
5,157,808 A 10/1992 Sterner, Jr.
5,189,838 A 3/1993 Westfall
5,210,976 A 5/1993 Cripps
5,232,208 A 8/1993 Braid et al.
5,251,401 A 10/1993 Prete et al.
5,301,467 A 4/1994 Schmidt et al.
5,353,548 A 10/1994 Westfall
5,365,638 A 11/1994 Braid et al.
5,371,971 A 12/1994 Prete
5,377,384 A 1/1995 Riegelman
5,383,303 A 1/1995 Nakanishi et al.
D355,262 S 2/1995 Chaney et al.
5,440,837 A 8/1995 Piltinsgrud
5,445,364 A 8/1995 Tibbals, Jr.
5,448,858 A 9/1995 Briggs et al.
5,452,495 A 9/1995 Briggs
5,463,793 A 11/1995 Westfall
5,463,795 A 11/1995 Carlson et al.
5,530,991 A 7/1996 deNormand et al.
5,544,450 A 8/1996 Schmidt et al.
5,553,903 A 9/1996 Prete et al.
5,566,507 A 10/1996 Schmidt et al.
5,572,828 A 11/1996 Westfall
5,615,452 A 4/1997 Habbersett
5,632,117 A 5/1997 Prete et al.
5,632,118 A 5/1997 Stark
5,661,927 A 9/1997 Polowinczak et al.
5,669,180 A 9/1997 Maier
5,697,188 A 12/1997 Fullick et al.
5,699,636 A 12/1997 Stark
5,704,165 A 1/1998 Slocomb et al.
5,737,877 A 4/1998 Meunier et al.
5,802,767 A 9/1998 Slocomb et al.
5,806,243 A 9/1998 Prete et al.
5,806,900 A 9/1998 Bratcher et al.
5,829,196 A 11/1998 Maier
5,852,854 A 12/1998 Pierrot et al.
5,855,092 A 1/1999 Raap et al.
5,873,199 A 2/1999 Meunier et al.
5,924,243 A 7/1999 Polowinczak et al.
5,927,013 A 7/1999 Slocomb et al.
1,312,665 A 8/1999 Almquist
5,943,822 A 8/1999 Slocomb et al.
5,996,283 A 12/1999 Maier
6,032,417 A 3/2000 Jakus et al.
6,041,475 A 3/2000 Nidelkoff
6,041,476 A 3/2000 deNormand
6,041,550 A 3/2000 Tix

(56) References Cited

U.S. PATENT DOCUMENTS 6,058,653 A 5/2000 Slocomb et al.
6,119,398 A 9/2000 Yates, Jr.
D434,637 S 12/2000 Habeck et al.
6,155,615 A 12/2000 Schultz
6,161,335 A 12/2000 Beard et al.
6,161,657 A 12/2000 Zhuang
6,178,696 B1 1/2001 Liang
6,226,923 B1 5/2001 Hicks et al.
6,305,126 B1 10/2001 Hendrickson et al.
6,378,169 B1 4/2002 Batten et al.
6,393,661 B1 5/2002 Braid et al.
D462,258 S 9/2002 Meunier
D464,256 S 10/2002 Meunier
6,467,128 B1 10/2002 Damani
6,470,530 B1 10/2002 Trunkle
D467,490 S 12/2002 Uken et al.
6,553,620 B2 4/2003 Guillemet et al.
6,584,644 B2 7/2003 Braid et al.
6,606,761 B2 8/2003 Braid et al.
6,622,342 B1 9/2003 Annes et al.
6,679,000 B2 1/2004 Uken et al.
6,763,550 B2 7/2004 Regnier
6,820,368 B2 11/2004 Uken et al.
6,840,011 B2 1/2005 Thompson et al.
6,848,148 B2 2/2005 Braid et al.
6,857,228 B2 2/2005 Kunz et al.
6,860,066 B2 3/2005 Kunz et al.
6,892,494 B2 5/2005 Malek
6,931,788 B2 8/2005 Uken et al.
6,934,998 B1 8/2005 Shuler
6,983,513 B2 1/2006 Pettit
6,990,710 B2 1/2006 Kunz et al.
7,013,529 B2 3/2006 Pettit
7,076,835 B2 7/2006 Harold et al.
7,143,475 B2 12/2006 Annes et al.
7,191,562 B2 3/2007 Uken et al.
7,500,701 B2 * 3/2009 Lalancette ..... F16B 5/0275 292/256
7,552,510 B2 6/2009 Harold et al.
7,587,787 B2 9/2009 Pettit
7,673,372 B2 3/2010 Annes et al.
7,703,175 B2 4/2010 Tuller
7,735,191 B2 6/2010 Tuller
7,937,809 B2 5/2011 Tuller
7,945,994 B2 5/2011 Dallas et al.
7,966,770 B1 6/2011 Kunz
8,074,402 B2 12/2011 Tuller
8,132,290 B2 3/2012 Liang et al.
8,181,396 B1 5/2012 Kunz
8,313,310 B2 11/2012 Uchikado
8,365,356 B2 2/2013 Robertson
8,371,068 B1 2/2013 Kunz
8,424,248 B2 4/2013 Uken et al.
8,505,242 B1 8/2013 Kunz
8,539,642 B2 9/2013 Baker
8,561,260 B2 10/2013 Baker et al.
8,640,383 B1 2/2014 Kunz
8,813,310 B2 8/2014 Baker et al.
8,819,896 B2 9/2014 Kellum, III et al.
8,850,745 B2 * 10/2014 Sofianek ..... E05D 13/12 49/447
8,918,979 B2 12/2014 Baker
RE45,328 E 1/2015 Tuller
8,966,822 B2 3/2015 Sofianek et al.
9,003,710 B2 4/2015 Kellum, III et al.
9,121,209 B2 9/2015 Baker et al.
9,133,656 B2 9/2015 Steen et al.
9,458,655 B2 10/2016 deNormand
9,476,242 B2 10/2016 Baker
9,580,950 B2 2/2017 Uken et al.
9,644,768 B2 * 5/2017 Skinner ..... B29C 45/0005
9,995,072 B2 6/2018 Baker
10,081,972 B1 9/2018 Kunz
10,174,537 B1 1/2019 Kunz
10,208,517 B2 2/2019 Lucci et al.
10,344,514 B2 7/2019 Uken
10,415,287 B1 9/2019 Kunz
10,533,359 B2 1/2020 Uken
10,563,440 B2 * 2/2020 Kellum ..... E05D 15/22
10,563,441 B2 2/2020 Kellum
2002/0053117 A1 5/2002 Braid et al.
2002/0092241 A1 7/2002 Uken et al.
2002/0104189 A1 8/2002 Braid et al.
2002/0129463 A1 9/2002 Newman
2003/0074764 A1 4/2003 Pettit et al.
2003/0192147 A1 10/2003 Braid et al.
2003/0192257 A1 10/2003 Uken et al.
2003/0213096 A1 11/2003 Annes et al.
2004/0006845 A1 1/2004 Polowinczak et al.
2004/0163209 A1 8/2004 Pettit
2004/0216380 A1 11/2004 Uken et al.
2004/0237256 A1 12/2004 Lutfallah
2004/0244158 A1 12/2004 Awakura et al.
2004/0244295 A1 12/2004 Derham et al.
2005/0055802 A1 3/2005 Braid et al.
2005/0091791 A1 5/2005 Kunz
2005/0160676 A1 * 7/2005 Pettit ..... E05D 15/22 49/447
2005/0178068 A1 8/2005 Uken et al.
2005/0198775 A1 9/2005 Pettit et al.
2005/0229492 A1 10/2005 Robertson
2006/0021283 A1 * 2/2006 Schultz ..... E05D 13/1276 49/445
2006/0086052 A1 4/2006 Petta et al.
2006/0207185 A1 9/2006 Shuler et al.
2007/0011846 A1 1/2007 Braid et al.
2007/0101654 A1 5/2007 Robertson
2007/0113479 A1 5/2007 Uken et al.
2008/0047099 A1 2/2008 Malek
2008/0120804 A1 5/2008 Annes et al.
2008/0178424 A1 7/2008 Tuller
2008/0178425 A1 7/2008 Tuler
2009/0188075 A1 7/2009 Baker
2009/0260295 A1 10/2009 Tuller
2010/0115854 A1 5/2010 Uken et al.
2011/0067314 A1 3/2011 Baker
2011/0239402 A1 10/2011 Steen et al.
2012/0297687 A1 11/2012 Baker et al.
2013/0283699 A1 10/2013 Kellum, III et al.
2013/0340349 A1 12/2013 Baker
2014/0000172 A1 1/2014 Sofianek
2014/0026490 A1 1/2014 Baker et al.
2014/0208653 A1 7/2014 Sofianek et al.
2014/0208655 A1 7/2014 Stoakes et al.
2014/0259524 A1 9/2014 Kellum, III et al.
2014/0259936 A1 9/2014 DeNormand et al.
2014/0331561 A1 11/2014 Baker et al.
2015/0167379 A1 6/2015 Sofianek et al.
2015/0361701 A1 12/2015 Steen et al.
2015/0368952 A1 12/2015 Baker et al.
2016/0222709 A1 8/2016 Wynder
2016/0298368 A1 10/2016 Kunz
2016/0298369 A1 10/2016 Kunz
2017/0089109 A1 3/2017 Steen et al.
2017/0145722 A1 5/2017 Kellum, III
2017/0211305 A1 7/2017 Uken et al.
2017/0292303 A1 10/2017 Lucci
2017/0370138 A1 12/2017 Uken et al.
2018/0261660 A1 10/2018 Kellum
2019/0085609 A1 3/2019 Kellum
2020/0157863 A1 * 5/2020 Kellum ..... E05D 13/1276
2020/0224472 A1 7/2020 Uken
2020/0318408 A1 10/2020 Steen
2022/0034138 A1 2/2022 Kellum

FOREIGN PATENT DOCUMENTS

CA 2382933 4/2002
CA 2338403 4/2006
CA 2596293 2/2008
CA 2619267 7/2008
CA 2619289 7/2008
CA 2820240 1/2014
CA 2836375 7/2014

(56) References Cited

FOREIGN PATENT DOCUMENTS

| | | |
|---|---|---|
| DE | 4211695 | 10/1992 |
| GB | 329996 | 5/1930 |
| GB | 723056 | 2/1955 |
| GB | 740223 | 11/1955 |
| GB | 1505782 | 3/1978 |
| GB | 2195691 | 4/1988 |
| GB | 2236786 | 4/1991 |
| GB | 2254875 | 10/1992 |
| GB | 2276655 | 10/1994 |
| GB | 2278626 | 12/1994 |
| GB | 2280697 | 2/1995 |
| GB | 2292168 | 2/1996 |
| GB | 2295634 | 6/1996 |
| JP | 56-171982 | 1/1981 |
| JP | 03197785 | 8/1991 |
| JP | 5-52273 | 7/1993 |
| JP | 3025244 | 6/1996 |
| JP | 63-3785 | 1/1998 |
| JP | 2000283025 | 10/2000 |
| JP | 2004293388 | 10/2004 |
| JP | 2005113907 | 4/2005 |

OTHER PUBLICATIONS

Balance Systems—BSI Amesbury Group, Inc. Crossbow Balance Advertisement dated Jun. 7, 1999 (3 pgs.).

BSI Tilt Balance Systems, Balance Systems—BSI, Amesbury Group, Inc., 1996-2001, 4 pgs.

BSI's Hidden Advantage: It's as Easy as 1-2-3, Balance Systems—BSI, Amesbury Group, Inc., 2001, 3 pgs.

Response By Patent Owner to Office Action in EX-Parte Re-Examination Pursuant to 37 C.F.R. 1.550(e) for co-pending U.S. Appl. No. 90/013,695, filed Aug. 23, 2016, 13 pages.

Crossbow Balance! Another New Balance in BSI's Quiver, Balance Systems—BSI, Amesbury Group, Inc., Jun. 7, 1999, 2 pgs.

Dakota Balance—Balances and Accessories brochure, May 2001, 2 pgs.

DWM Door & Window Maker Magazine, "2004 Annual Buyers Guide", vol. 5, Issue 3, Apr. 2004, 2 pgs.

Ex-Parte Re-Examination Office Action for corresponding U.S. Re-Examination U.S. Appl. No. 90/013,695 dated Jun. 23, 2016, 8 pgs.

Heinberg, "Latest Trends in Window and Door Hardware," Shelter Magazine, Jul. 2001, cover and p. 11.

PCT International Search Report, Written Opinion, and International Preliminary Report on Patentability (with 37 sheets of annexes) for PCT/US2011/024134; ISA/US, dated Feb. 9, 2011 (113 pages total).

Photographs of the Crossbow Balance Component shown in C6 (7 views; 3 pgs).

PCT International Search Report and Written Opinion in International Application PCT/US2018/026500, dated Jun. 22, 2018, 13 pages.

PCT International Preliminary Report on Patentability in Application PCT/US2018/026500, dated Oct. 17, 2019, 7 pages.

* cited by examiner

INVERTED CONSTANT FORCE WINDOW BALANCE HAVING SLIDABLE COIL HOUSING

CROSS-REFERENCE TO RELATED APPLICATIONS

This application claims priority to and the benefit of U.S. Provisional Patent Application No. 62/790,210, filed on Jan. 9, 2019, the disclosure of which is hereby incorporated herein by reference in its entirety.

INTRODUCTION

Sash windows assemblies include one or more moveable panels or sashes. These moveable sashes typically slide within or along a window jamb and may include one or more balance assemblies or systems mounted within the space between the sash and the jamb to assist with the sliding movement of the sash. Some known sash windows assemblies allow for the sash to pivot relative to the jamb such that the sash may be tilted inwards for cleaning and/or installation/removal purposes. As such, the balance systems may include a carrier assembly that holds in place within the window jamb to prevent retraction of the balance system due to the titled and/or removed sash.

At least some known inverted constant force window balance systems include a carrier assembly that is coupled to the window sash through a pivot bar. The carrier assembly carries a coil spring having a free end secured to a window jamb channel with a mounting bracket, screw, or other element. As the coil spring unwinds from the sliding movement of the sash, the recoil tendency of the spring produces a retraction force to counter the weight of the window sash. As the window sash tilts, a locking element of the carrier assembly extends outward so as to contact the jamb channel and hold the carrier assembly in place to prevent the coil spring from retracting in the absence of the weight of the sash.

SUMMARY

In one aspect, the technology relates to an inverted constant force window balance system including: a carrier assembly including: a housing including a first housing wall and a second housing wall substantially parallel to the first housing wall; a coil spring disposed within the housing, the coil spring including a free end; and a shoe assembly slidably coupled to the housing, wherein the shoe assembly includes a first shoe face and a second shoe face substantially parallel to the first shoe face, wherein the housing is configured to slide between a first position and a second position relative to the shoe assembly, wherein when in the first position, the first housing wall and the second housing wall are substantially non-coplanar with the first shoe face, wherein when in the second position, the first housing wall is substantially coplanar with the first shoe face and substantially non-coplanar with the second shoe face, and wherein the shoe assembly is configured to receive a pivot bar from a window sash and extend at least one brake upon rotation of the pivot bar; and a mounting bracket releasably coupled to the housing opposite the shoe assembly and coupled to the free end of the coil spring.

In an example, at least a portion of the mounting bracket is configured to slideably move in relation to the free end of the coil spring between at least two mounting bracket positions, and when at least a portion of the mounting bracket moves between the at least two mounting bracket positions, the mounting bracket disengages from the housing. In another example, the mounting bracket includes a jamb mount and a coil spring mount, the jamb mount is configured to slide in relation to the coil spring mount between a first jamb mount position and a second jamb mount position, and when in the first jamb mount position, the jamb mount is releasably engaged with the housing and when in the second jamb mount position, the jamb mount is disengaged from the housing. In yet another example, the shoe assembly includes a housing including a first leg and a second leg, the first leg and the second leg are separated by and at least partially define a throat. In still another example, when in the second position, a portion of the throat proximate the second shoe face is configured to receive a pivot bar in a pivot bar insertion direction substantially parallel to the second housing wall. In an example, the shoe assembly further includes a rotatable cam disposed at a lower portion of the throat.

In another example, the rotatable cam defines a keyhole, and in a first rotated position, the keyhole is in communication with the throat, and in a second rotated position, the keyhole is not in communication with the throat. In yet another example, the shoe assembly includes a friction screw extending from the first shoe face to the second shoe face. In still another example, the friction screw defines, at each end, an engagement slot. In an example, the housing is configured to slide between the first position and a third position relative to the shoe assembly, and when in the third position, the second housing wall is substantially coplanar with the second shoe face and substantially non-coplanar with the first shoe face.

In another aspect, the technology relates to a method of installing an inverted constant force window balance system having a mounting bracket, a coil housing, a coil, and a shoe, the method including: inserting the inverted constant force window balance system into a window jamb; sliding the coil housing from a first housing position to a second housing position, wherein in the first housing position, the coil housing is substantially centered on the shoe, and wherein in the second housing position, a first wall of the coil housing is substantially coplanar with a first face of the shoe; and securing the mounting bracket to the window jamb.

In an example, the method further includes sliding the mounting bracket from a first bracket position adjacent the first wall of the coil housing to a second bracket position adjacent a second wall of the coil housing. In another example, securing the mounting bracket and sliding the mounting bracket are performed substantially simultaneously. In yet another example, in the first bracket position, a portion of a first side of the mounting bracket is substantially coplanar with the first wall of the coil housing and in contact with the window jamb. In still another example, after inserting the inverted constant force window balance system into the window jamb, a first side of the mounting bracket is in contact with the jamb channel. In an example, subsequent to sliding the coil housing, the mounting bracket is not in contact with the window jamb, and securing the mounting bracket to the jamb channel includes placing the mounting bracket in contact with the window jamb.

In another example, the method further includes disengaging the mounting bracket from the coil housing. In yet another example, the securing operation and the disengaging operation are performed substantially simultaneously.

In another aspect, the technology relates to an inverted constant force window balance system including a shoe assembly including a friction screw extending from a first shoe face to a second shoe face, wherein the friction screw defines, at each end, an engagement slot.

In an example, a coil housing is detachably connected to the shoe assembly.

BRIEF DESCRIPTION OF THE DRAWINGS

There are shown in the drawings examples that are presently preferred, it being understood, however, that the invention is not limited to the precise arrangements and configurations shown.

DETAILED DESCRIPTION

The examples of a window balance system described herein enable a more efficient inverted constant force balance for use with hung window assemblies. In aspects, the window balance system includes a two-piece mounting bracket that facilitates a more secure connection to a window jamb because a portion slideably mounts flush to the jamb while maintaining connection to the coil spring. Additionally, the mounting bracket may slide along the top of the window balance system enabling the window balance system to be installed on both the left and right side of the window sash (or in each opposing jamb channel) without any modification. As such, the window balance system described herein is not limited to being installed in a single position or orientation. Moreover, a releasable coupling between the mounting bracket and a carrier assembly is robust and decreases undesirable decoupling during shipping, as well as decreases installation time in hung window assemblies.

Furthermore, the window balance system described herein is fully modular and thus can be adapted and configured to a wide range window sash weights from many different window manufacturers. In examples, smaller (e.g., narrower) coil springs and housings may be used with larger (e.g., deeper) shoe assemblies. This allows for a reduction in the numbers of coil springs and coil housings maintained in a balance manufacturer's inventory, while still enabling a wide range of jamb channels depths to be accommodated. The window balance system described herein increases ease of use for installers and adaptability for many different hung window assembly sizes.

Examples of inverted constant force window balances that include certain components and features of the inverted constant force window balances described herein are depicted and described in U.S. Patent Application Publication No. 2018/0291660, the disclosure of which is hereby incorporated by reference herein in its entirety. Further, although the inverted constant force window balances depicted herein utilize only a single leading coil housing, examples may also utilize both leading and trailing coil housings, as such housings are described in the above-referenced publication. In such a configuration, both the leading and trailing coil housings may slide relative to the shoe assembly, wherein the sliding movement is described herein.

Figure 1:
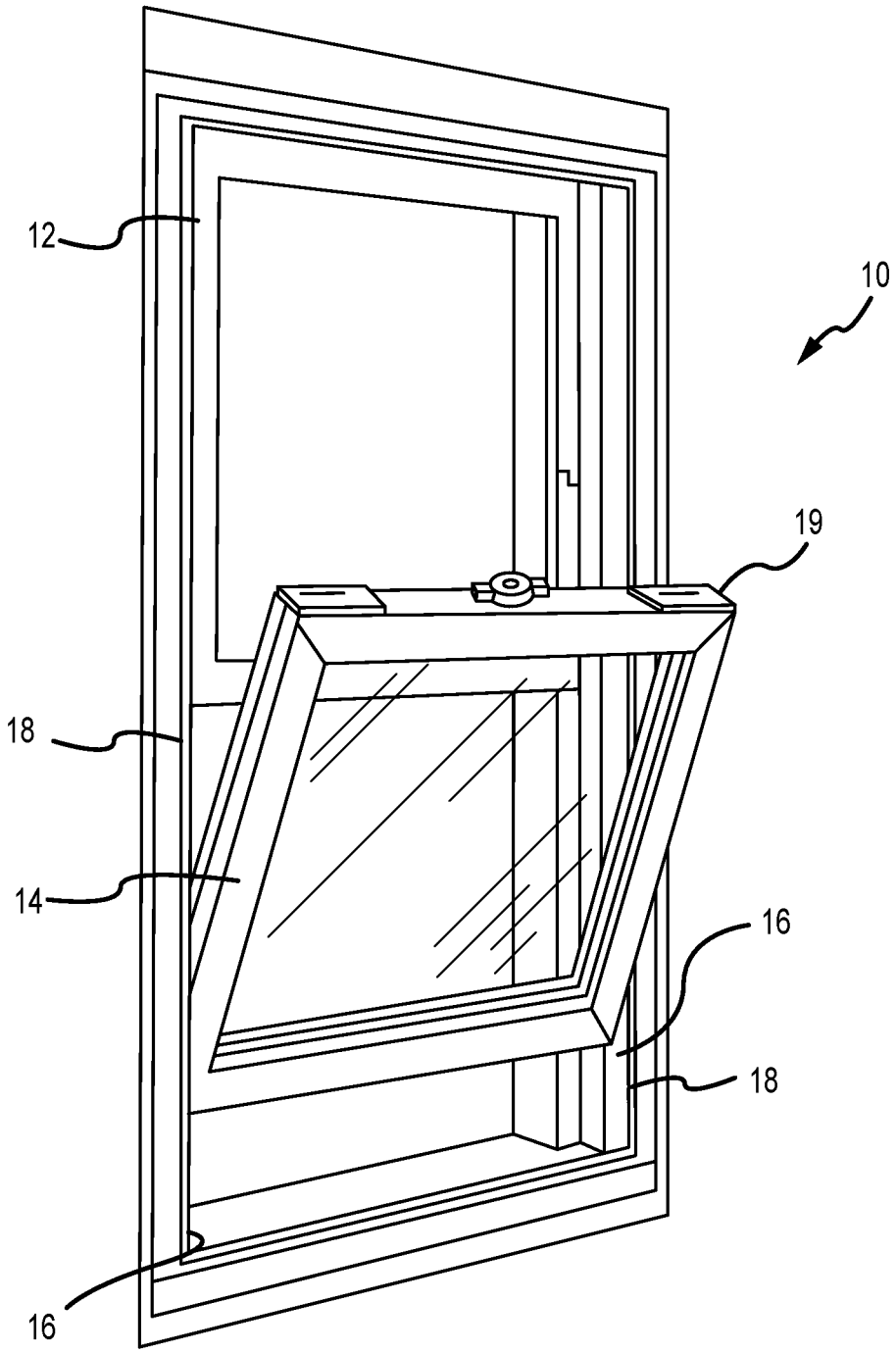
FIG. 1 is a perspective view of a hung window frame assembly.

FIG. 1 is a perspective view of a hung window frame assembly 10. A pair of window sashes 12, 14 are disposed in vertical alignment with a window jamb 16 that forms the side of a window frame 18. Typically, in a single hung window assembly, the upper sash 12 is fixed relative to the window frame 18 and the lower sash 14 is slideable within the window frame 18, while in a double hung window assembly, both the upper sash 12 and the lower sash 14 are slideable within the window frame 18. To counter balance the weight of the slideable window sashes 12 and/or 14 and to assist in the vertical sliding of the window sashes 12 and/or 14 within the window frame 18, a window balance system (shown in FIG. 2A and elsewhere herein) is provided. The window balance system is mounted within the window jamb 16 and is coupled to the window sash 12, 14, thereby forming a load path that enables support of the window sash 12, 14. In the example, the window frame assembly 10 is configured for vertically sliding sashes 12, 14. In alternative embodiments, the window frame assembly may be configured for horizontally sliding sashes and which may include the window balance systems described herein.

Each window sash 12, 14 may also include tilt latches 19, positioned at a top portion of the sash, and pivot bars (as described elsewhere herein) extending from a lower portion of the sash. The tilt latches 19 and pivot bars enable the window sash 12, 14 to pivot relative to, and be removed from, the window jamb 16 and facilitate sash installation and/or window cleaning. Each pivot bar may be coupled to the window balance system, which is configured to enable both the sliding movement of the window sash 12, 14 and the pivoting movement of the window sash 12, 14. Generally, a single window balance system is installed on either side of each window sash 12, 14 and within the corresponding window jamb 16.

Figure 2A:
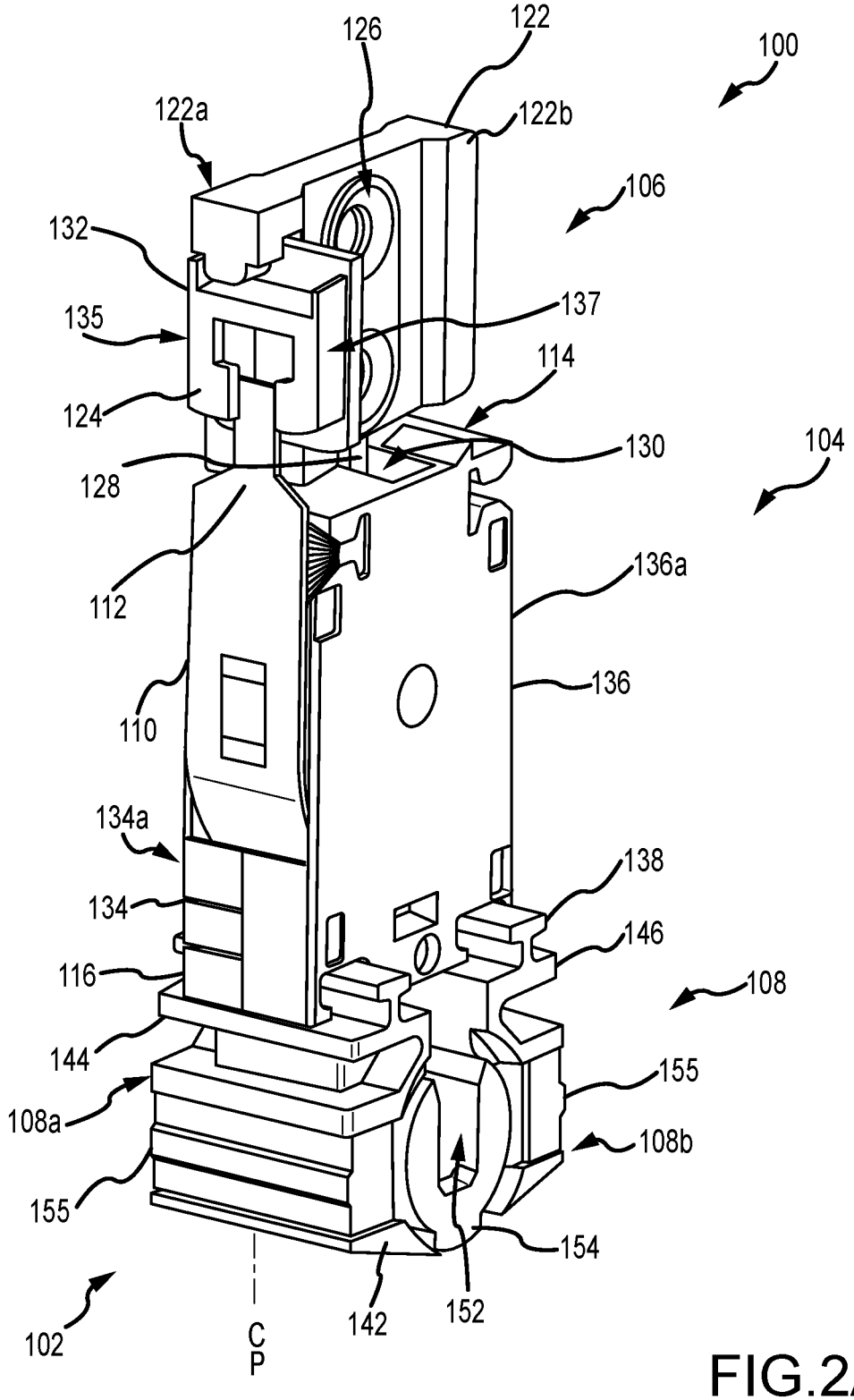
FIG. 2A is a perspective view of an inverted constant force window balance system.
Figure 2B:
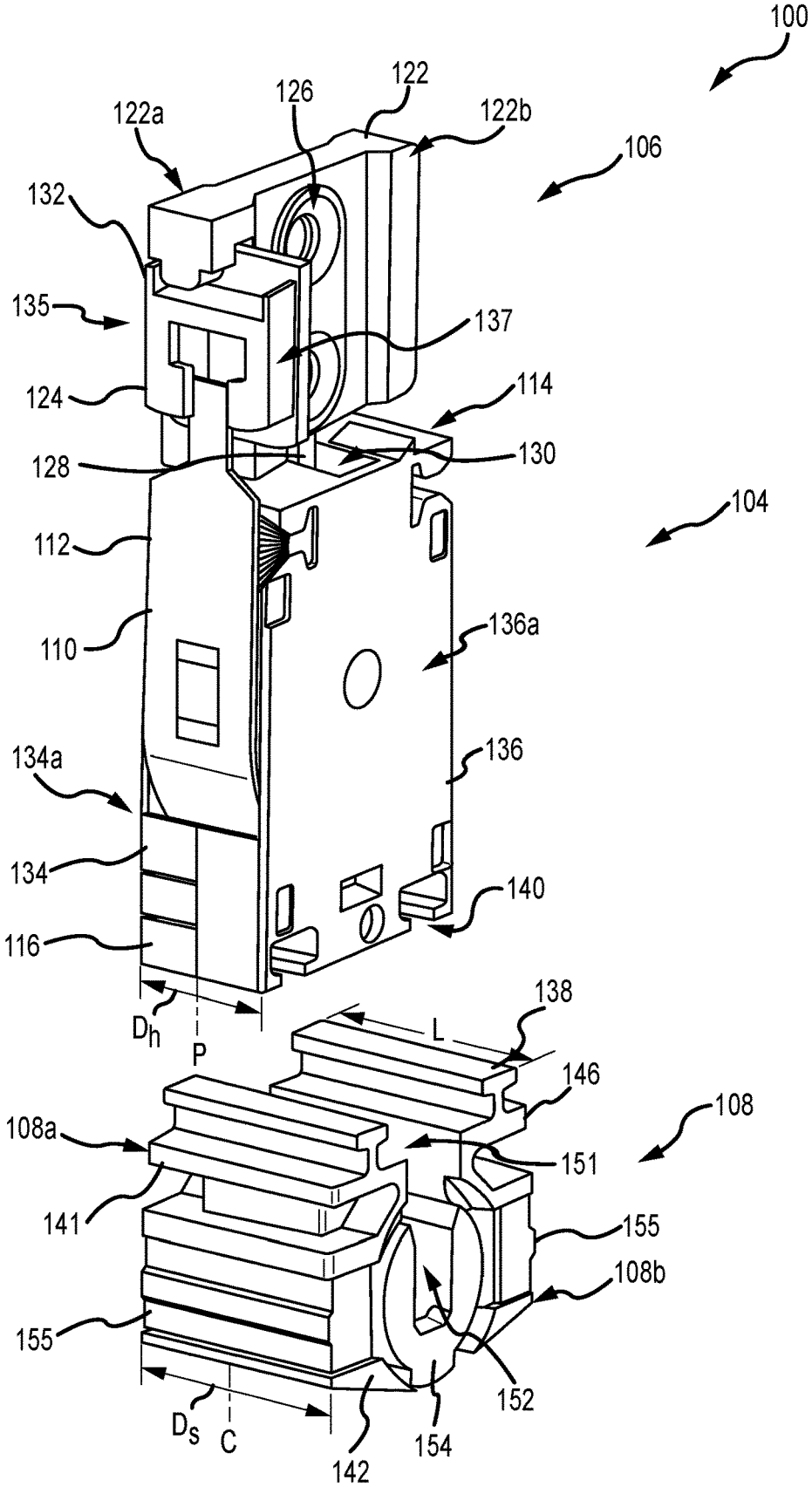
FIG. 2B is a partially exploded perspective view of the inverted constant force window balance of FIG. 2A.

FIG. 2A is a perspective view of an inverted constant force window balance system 100 that may be used with the hung window frame assembly 10 (shown in FIG. 1). FIG. 2B depicts a partially exploded view of the inverted constant force window balance system 100. FIGS. 2A and 2B are described concurrently. In this example, the window balance system 100 is illustrated in a shipping configuration 102 and includes a leading housing assembly 104, a mounting bracket 106, and a shoe assembly 108. The leading housing assembly 104 houses a coil spring 110, which includes a free end 112 that is coupled to the mounting bracket 106. A top end 114 of the leading housing assembly 104 is releasably coupled to the mounting bracket 106. A bottom end 116 of the leading housing assembly 104 is removably and slidably coupled to the shoe assembly 108 that enables the window balance system 100 to be secured within a window jamb during operation as described herein.

The mounting bracket 106 includes a jamb mount 122 and a coil spring mount 124. The jamb mount 122 includes at least one aperture 126 that enables a screw or other fastener element to couple the mounting bracket 106 to a window jamb during installation. The jamb mount 122 also includes a bottom extension element 128 that is configured to be removably received and engaged by a corresponding top receiving element 130 of the leading housing assembly 104. As such, the mounting bracket 106 is releasably coupled to the leading housing assembly 104. The coil spring mount 124 includes a body 132 that is configured to receive the free end 112 of the coil spring 110 so that the mounting bracket 106 is coupled to the coil spring 110.

In this example, the leading housing assembly 104 may be formed by two identical housing members 134, 136 that are joined at a mating plane P. In the shipping configuration 102, the jamb mount 122 is positioned proximate the first housing member 134 so that the jamb mount 122 is off-center relative to the leading housing assembly 104. Further, the housing assembly 104 is positioned such that the mating plane P is substantially aligned with a centerline C of the shoe assembly 108. From the shipping configuration, the window balance system 100 may be positioned in a window jamb on either side of a window. Thereafter, surfaces of the window balance system 100 proximate a rear wall of the jamb channel are aligned. For example, a first mounting surface 122*a* of the mounting bracket 106 is substantially aligned with a first wall 134*a* of the first housing member 134. Further, a first shoe face 108*a* is substantially aligned with the first wall 134*a*. This process is described in more detail in FIGS. 3A and 3B. An installation procedure that results in substantial alignment of a second mounting surface 122*b* of the mounting bracket 106, a second wall 136*a* of the second housing member 136, and a second shoe face 108*b* (and adjacent the rear wall of the jamb channel) is described below in FIGS. 4A-4C.

Slidable engagement between the coil housing 104 and the shoe assembly 108 is possible due to the presence of at least one extension 138 of the shoe assembly 108 that is slidably engaged with a mating channel 140 of the housing assembly 104, as well as the relative dimensions of the various components of the window balance system 100. The shoe assembly 108 defines a depth Ds (shown in FIG. 2B), which is generally related to a depth of the window jamb channel. That is, the depth Ds is generally similar to the depth of the window jamb, such that sufficient clearance exists between the shoe faces 108*a*, 108*b* and the jamb channel walls to avoid excess friction. However, the depth Ds should be such that excessive lateral movement of the shoe assembly in the jamb channel is minimized. The shoe assembly 108 is formed from a housing 142 that includes a first leg 144 and a second leg 146 separated by and at least partially defining a throat 151. In the depicted configuration, an extension 138 extends from each of the legs 144, 146, so as to engage with corresponding channels 140 on the coil housing 104. The coil housing 104 also has a depth Dh (shown in FIG. 2B), which is generally less than the shoe depth Ds, thus allowing the coil housing 104 to slide towards either of the first face 108*a* or second face 108*b*. A rotatable cam 154 is disposed in a lower portion of the throat 151. Once installed in the window jamb, the offset position of the coil housing 104 exposes the throat 151 (as depicted below). This allows a pivot bar (shown in FIG. 5) to be inserted into the throat 151 and into a keyhole 152 of the cam 154. When the keyhole 152 is in communication with the throat 151, as depicted in FIG. 2A, the pivot bar may be inserted or removed from the keyhole 152. However, the cam 154 can be rotated such that the keyhole 152 is not in communication with the throat 151. Based on the rotation of the cam 154, via the pivot bar, one or more brakes 155 are configured to extend from the legs 144, 146 of the shoe assembly 108.

Figure 3A:
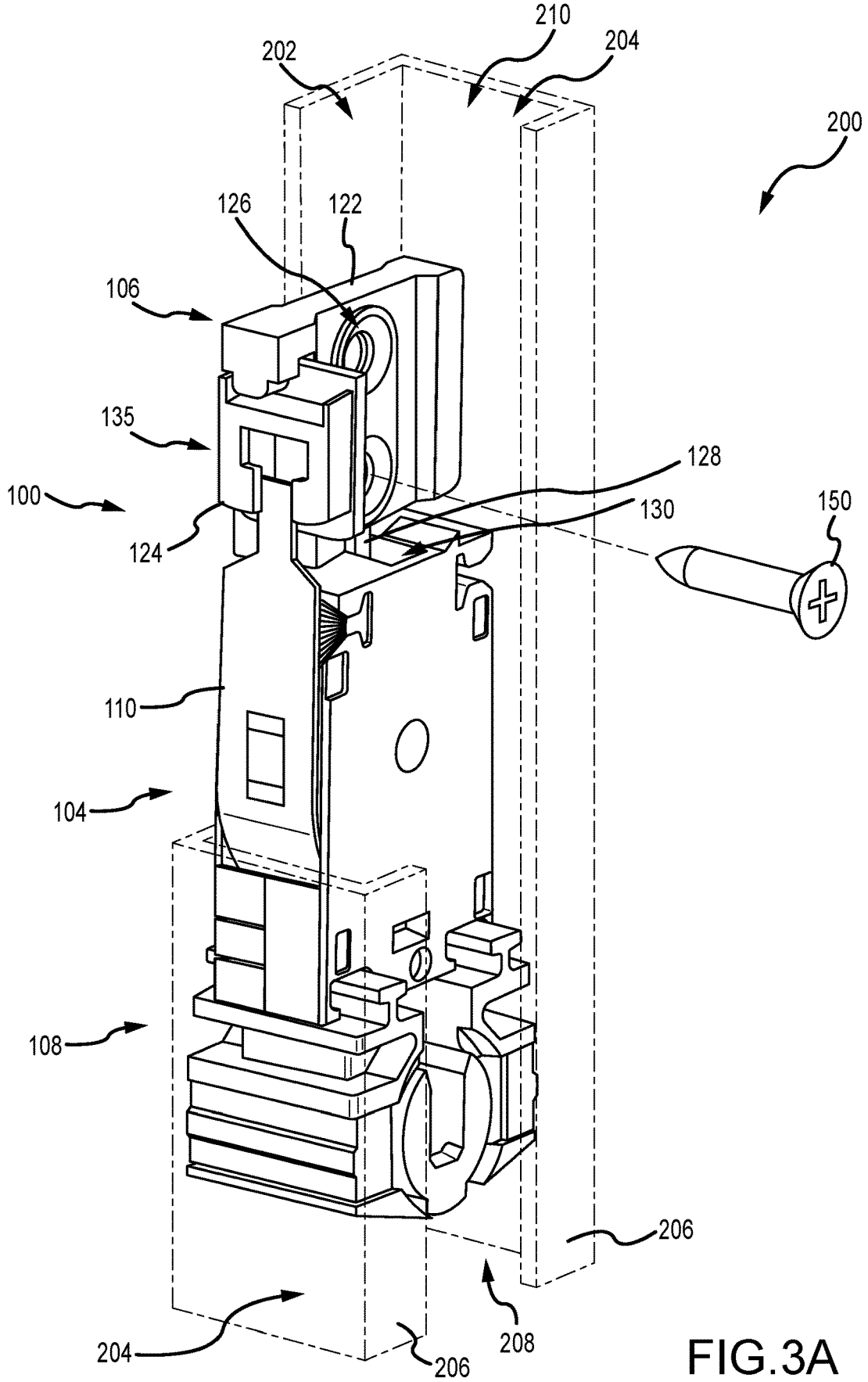
FIGS. 3A and 3B are perspective views of the inverted constant force window balance of FIG. 2A installed in a first side of a window jamb, at various stages during installation.
Figure 3B:
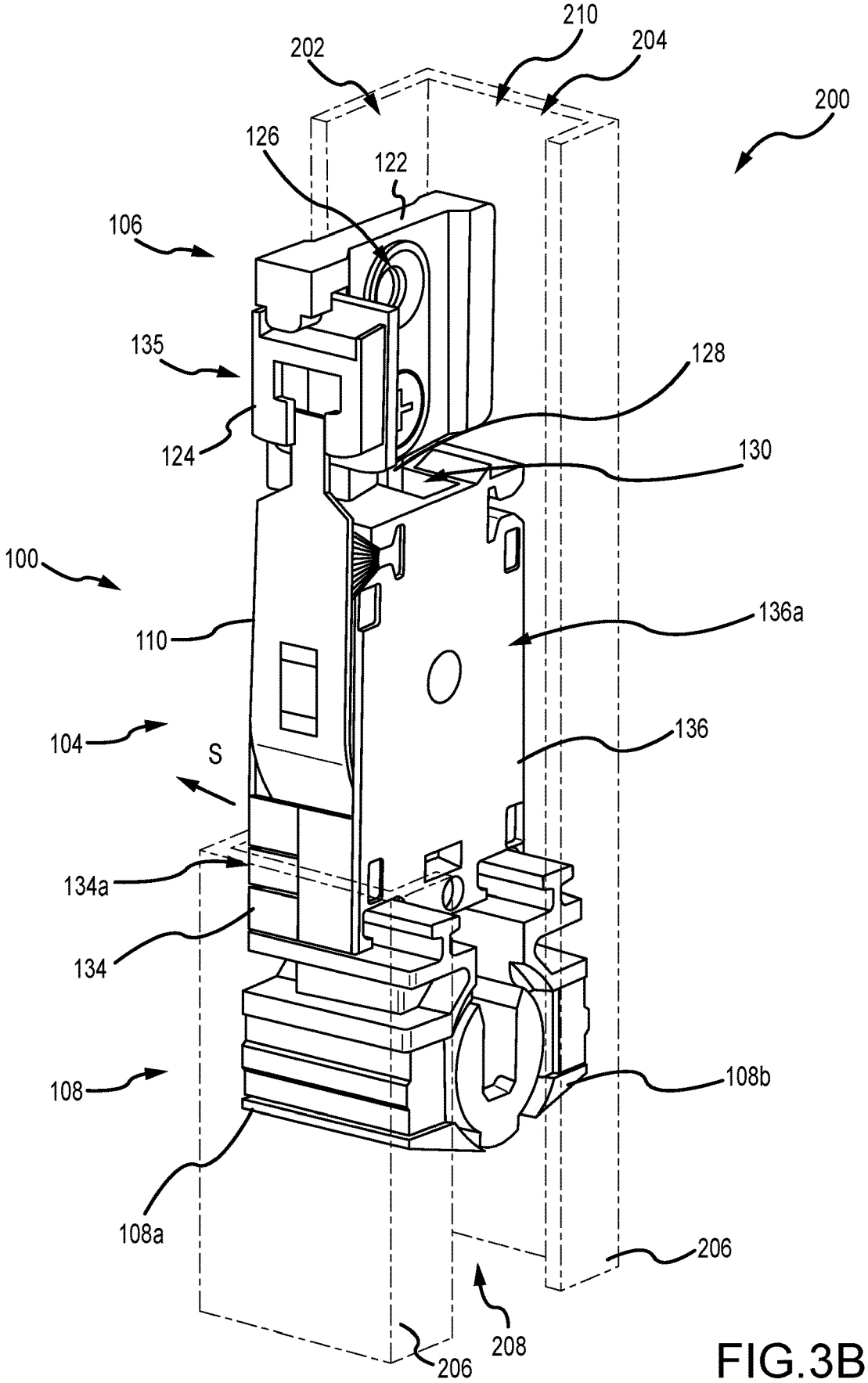

FIGS. 3A and 3B are perspective views of the inverted constant force window balance 100 of FIG. 2A installed in a first channel 200 of a window jamb, at various stages during installation. A number of features and components of the window balance system 100 are depicted but are not necessarily described further. For the purposes of this description of FIG. 3A, the window jamb channel 200 is the left-hand channel of a window, such that up and down operation of the window does not make visible the coil spring 110 to a person looking out the window from inside of a building. Of course, the window balance system 100 may be installed in the opposite configuration, with modifications to the method of installation. FIG. 3A depicts a jamb channel 200 having a rear wall 202, two side walls 204, and two front walls 206 defining a slot 208 therebetween. The window balance system 100 is inserted into the interior 210 of the channel 200 as known in the art. During insertion, the coil housing 104 is generally disposed on the centerline C of the shoe assembly 108 (e.g., as depicted in FIG. 2A). The mounting bracket 106 is disposed proximate a first wall 134*a* of the coil housing 104. Further, the first wall 134*a* and the second wall 136*a* are each parallel to and non-coplanar with the first face 108*a* and the second face 108*b* of the shoe assembly 108.

Once inserted, the coil housing is slid S towards the rear wall 202 of the jamb channel 200, as depicted in FIG. 3B. In examples, this sliding movement S may continue until contact is made between the rear wall 202 and the first wall 134*a* of the coil housing 104. In another example, the sliding movement S may continue until the first wall 134*a* of the coil housing 104 is substantially coplanar with the first face 108*a* of the shoe assembly 108 and non-coplanar with the second face 108*b*. In examples, contact with the rear wall 202 and coplanar alignment with the first face 108*a* may occur substantially simultaneously. Further, since the mounting bracket 106 is, in the shipping configuration, already substantially aligned with the first wall 134*a* of the coil housing 104, the sliding movement S positions the mounting bracket 106 proximate the rear wall 202. One or more fasteners 150, in the form of screws, bolts, nails, etc., may then be inserted into one or more of the apertures 126 so as to fix a position of the mounting bracket 106 in the jamb.

When the window balance system 100 is mounted with the first wall 134*a* of the first housing member 134 adjacent to the rear wall 202, the jamb mount 122 is fastened to the rear wall 202 such that the top receiving element 130 does not immediately release from the bottom extension element 128. Once the window sash is loaded on the shoe assembly 108, the top receiving element 130 moves in relation to the bottom extension element 128 and the leading housing assembly 104 is released from the mounting bracket 106. The movement of the top receiving element 130 may be sliding, pivoting, twisting, or a combination of two or more of these motions. This forms a first installed configuration, such that the leading housing assembly 104 is enabled to slide up and down within the window jamb and in relation to the mounting bracket 106. Additionally, when the jamb mount 122 is fastened to the window jamb, the jamb mount 122 substantially maintains its position on the coil spring mount 124. That is, proximate a first side 135 thereof as depicted in FIG. 3B.

Figure 4A:
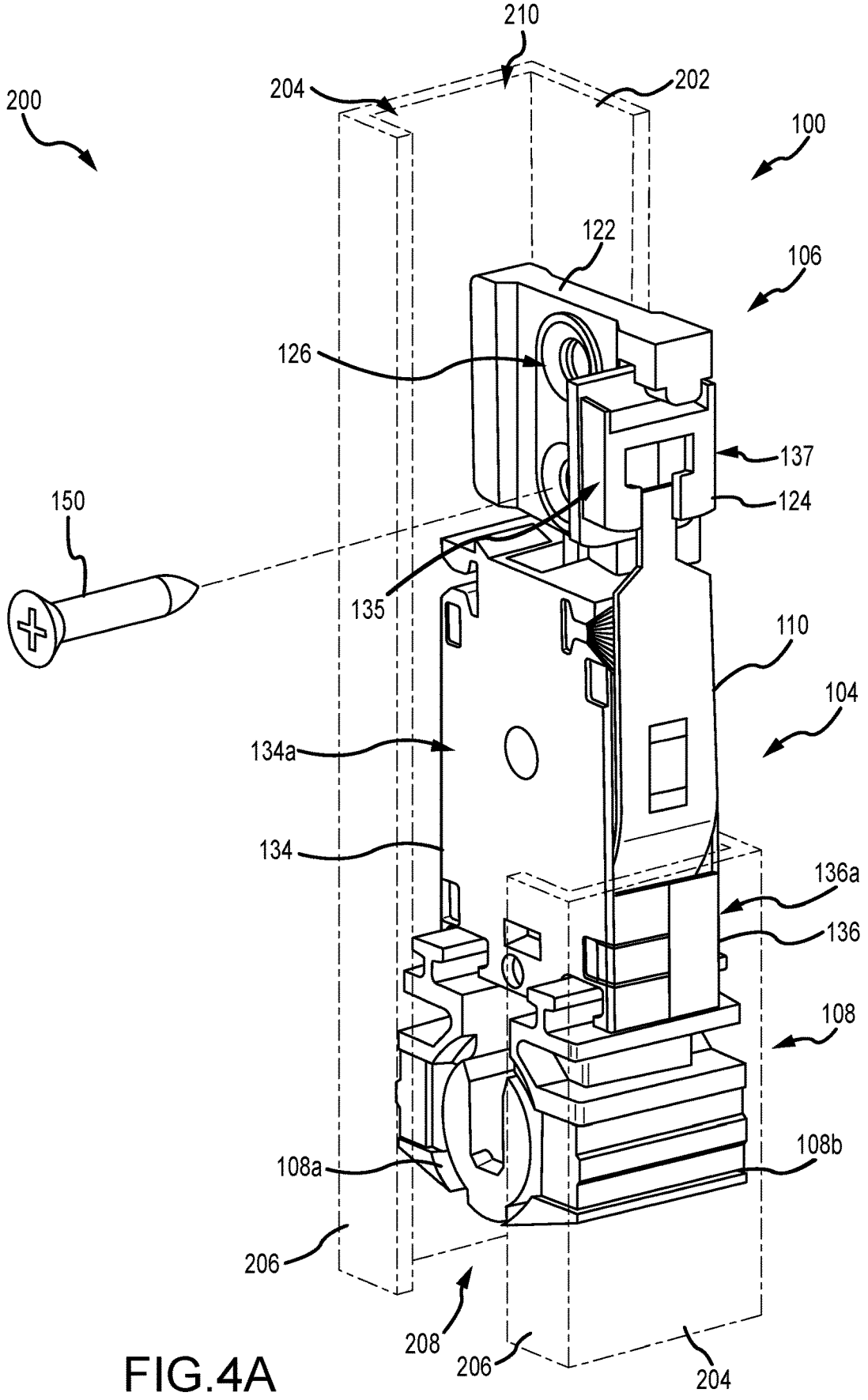
FIGS. 4A and 4B are perspective view of the inverted constant force window balance of FIG. 2A installed in a second side of a window jamb, at various stages during installation.
Figure 4B:
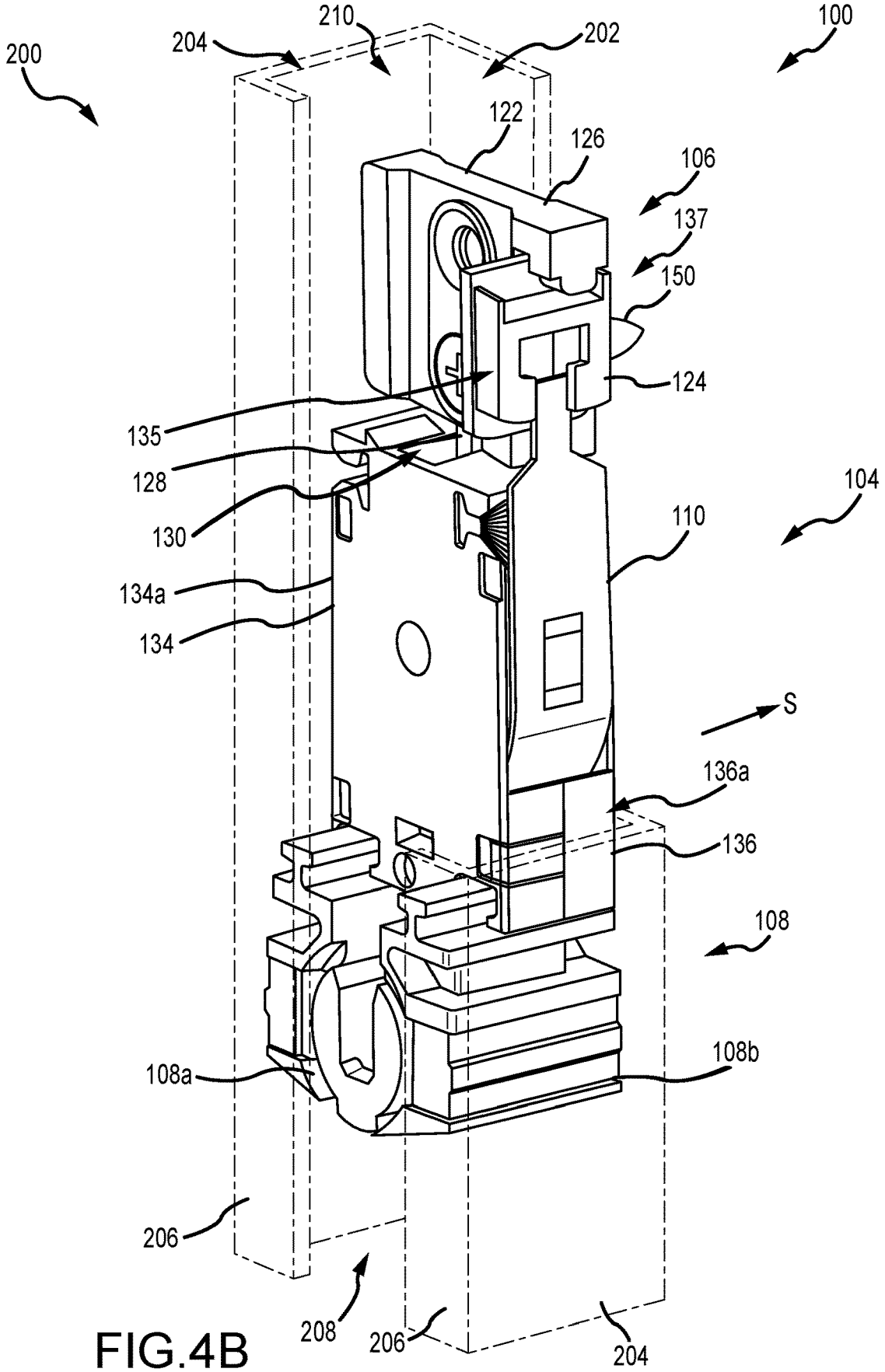

FIGS. 4A and 4B are perspective view of the inverted constant force window balance 100 of FIG. 2A installed in a second side of a window jamb 200, at various stages during installation. A number of features and components of the window balance system 100 are depicted but are not necessarily described further. For the purposes of this description of FIGS. 4A and 4B, the window jamb channel 200 is the right-hand channel of a window, such that up and down operation of the window does not make visible the coil spring 110 to a person looking out the window from inside of a building. Of course, the window balance system 100 may be installed in the opposite configuration, with modifications to the method of installation. FIG. 4A depicts a jamb channel 200 having a rear wall 202, two side walls 204, and two front walls 206 defining a slot 208 therebetween. The window balance system 100 is inserted into the interior 210 of the channel 200 as known in the art. During insertion, the coil housing 104 is generally disposed on the centerline C of the shoe assembly 108 (e.g., as depicted in FIG. 2A). The mounting bracket 106 is disposed proximate the first wall 134*a* of the coil housing 104.

Once inserted, the coil housing 104 is slid S towards the rear wall 202 of the jamb channel 200, as depicted in FIG. 4B. In examples, this sliding movement S may continue until contact is made between the rear wall 202 and the second wall 136*a* of the coil housing 104. In another example, the sliding movement S may continue until the second wall 136*a* of the coil housing 104 is substantially coplanar with the second face 108*b* of the shoe assembly 108. In examples, contact with the rear wall 202 and coplanar alignment with the second face 108*b* may occur substantially simultaneously. Thereafter, the mounting bracket 106 may be slid from its original position proximate the first wall 134*a* of the coil housing 104 to a position proximate the second wall 136*a*. In this position, the mounting bracket 106 is also proximate the rear wall 202 and ready to receive one or more fasteners 150 so as to fix a position of the mounting bracket 106 in the jamb.

When the window balance system 100 is mounted with the second wall 136*a* of the second housing member 136 on the rear wall 202, the jamb mount 122 is fastened to the rear wall 202 such that it moves from a position proximate the first housing member 134 to a position proximate the second housing member 136 and across the mating plane P (shown in FIG. 2B). This movement of the jamb mount 122 releases or disengages the top receiving element 130 from the bottom extension element 128. The movement of the jamb mount 122 may be sliding, pivoting, twisting, or a combination of two or more of these motions. This forms a second installed configuration, wherein the leading housing assembly 104 is enabled to slide up and down in the vertical direction within the window jamb and in relation to the mounting bracket 106. Additionally, when the jamb mount 122 slides from the first housing member 134 toward the second housing member 136, the jamb mount 122 also slides from the first side 135 of the coil spring mount 124 to a second side 137 of the coil spring mount 124. Although the jamb mount 122 slides across the mating plane P, the coil spring mount 124 maintains a centered position with regards to the leading housing assembly 104.

Figure 5:
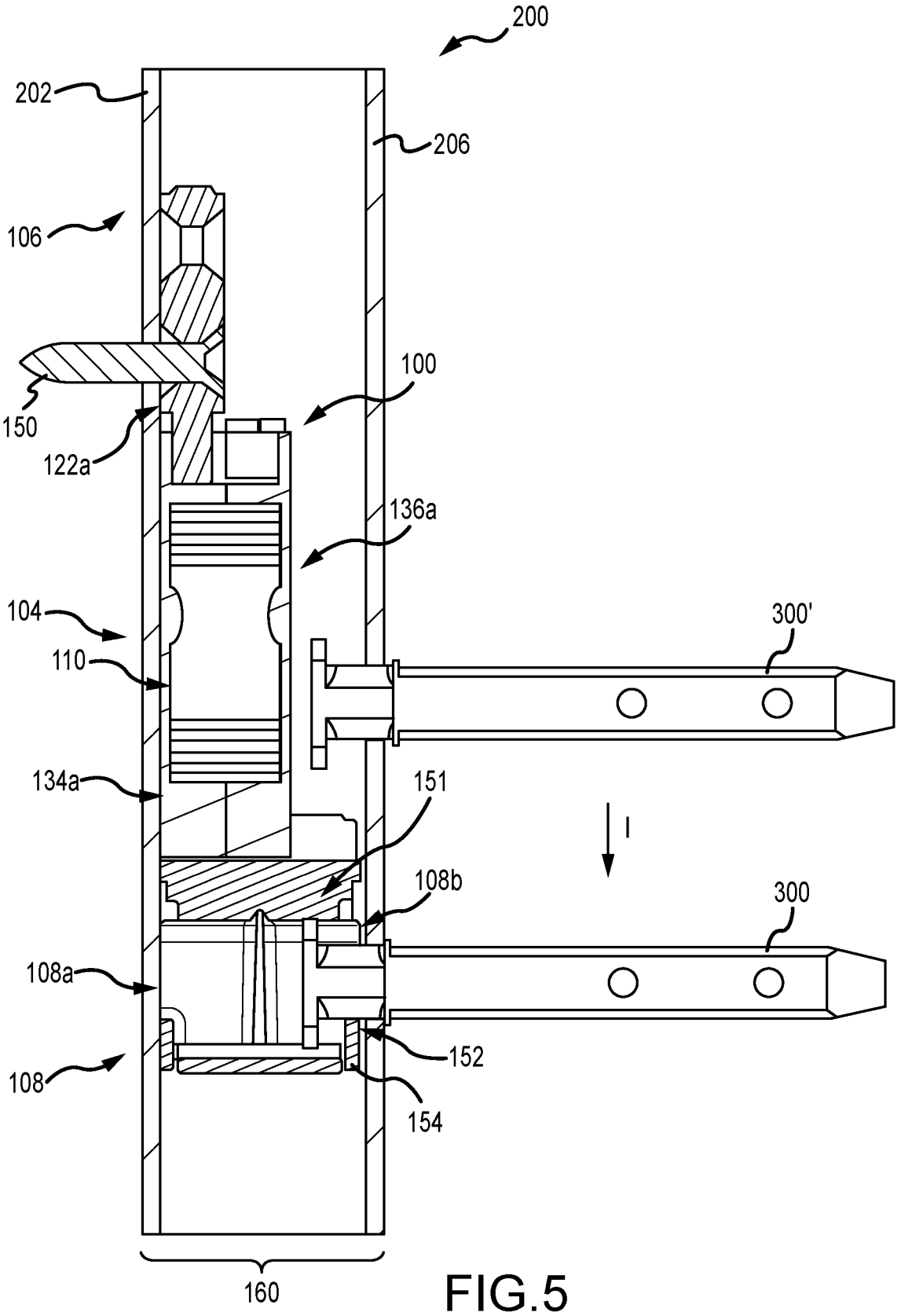
FIG. 5 is a side sectional view of a pivot bar being engaged with the inverted constant force window balance of FIG. 2A once installed in a window jamb.

FIG. 5 is a side sectional view of a pivot bar 300 being engaged with the inverted constant force window balance 100 of FIG. 2A once installed in a window jamb 200. In this installed configuration 160, the shoe assembly 108, the coil housing 104, and mounting bracket 106 are in contact with a rear wall 202 of the jamb channel 200. More specifically, the first mounting surface 122*a* of the mounting bracket 106 is in contact with the rear wall 202, due to the securement thereof via the mounting screw 150. The first wall 134*a* of the coil housing 104, as well as the first face 108*a* of the shoe assembly 108 are substantially coplanar with each other and slidably engaged with the rear wall 202 as the coil spring 110 is extended and retracted due to movement of the window sash. The window sash is secured to the window balance system 100 (and a second window balance system disposed in the opposite window jamb from that pictured) via a pivot bar 300. In the installed configuration 160 depicted in FIG. 5, the position of the coil housing 104 against rear wall 202 of the jamb channel significantly exposes the throat 151 of the shoe assembly 108. This enables insertion I of the pivot bar 300 from the position depicted at 300' to the position where pivot bar 300 is received in the keyhole 152 of the cam 154. In examples, this insertion I may be a direction that is substantially parallel to the second wall 136*a* of the coil housing 104, without interference between the pivot bar 300 or any component of the window balance system 100. This is a significant advantage over other window balance systems, where the window sash may need to be racked for proper installation.

Figure 6A:
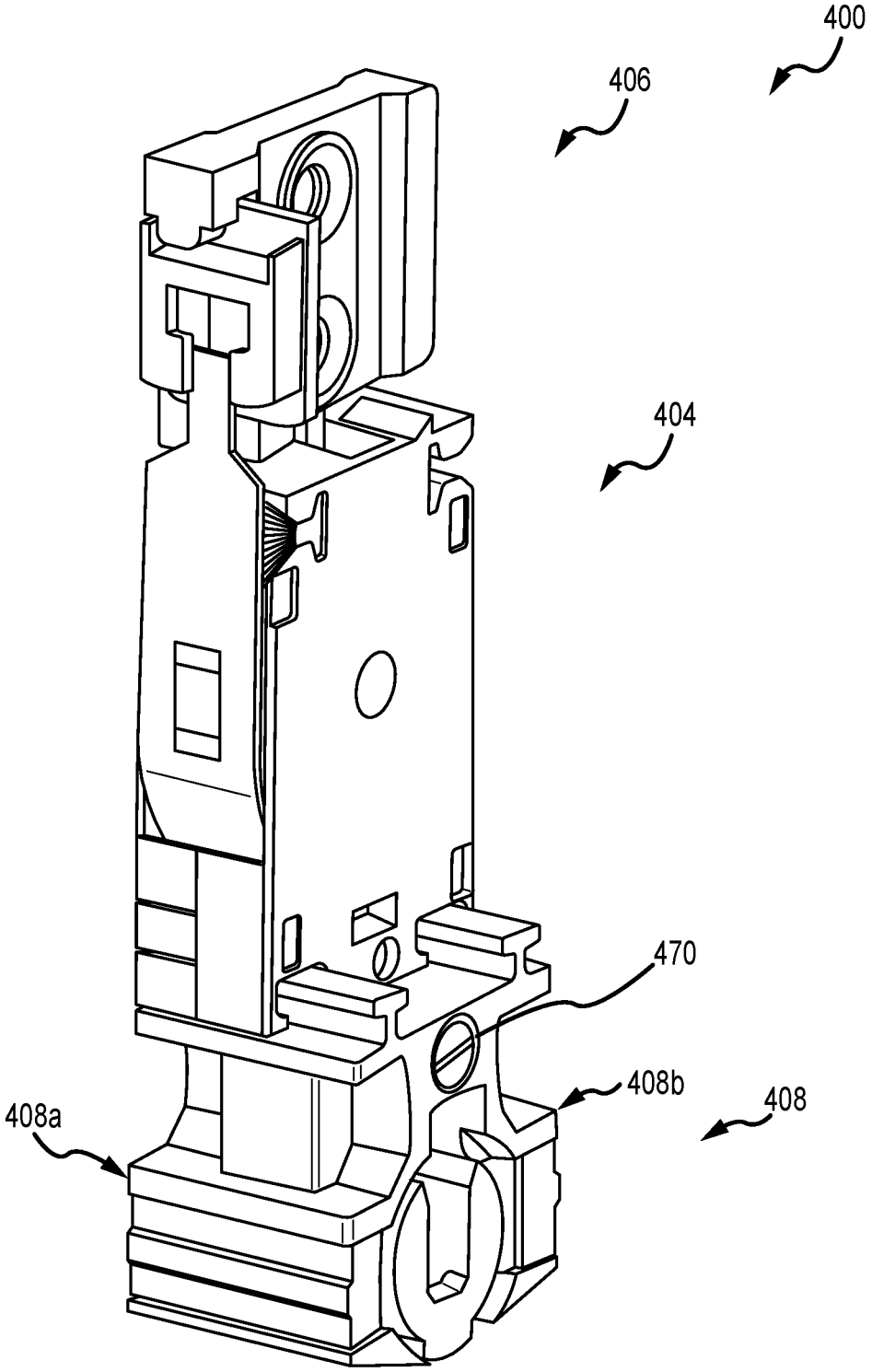
FIG. 6A is a perspective view of another inverted constant force window balance system.
Figure 6B:
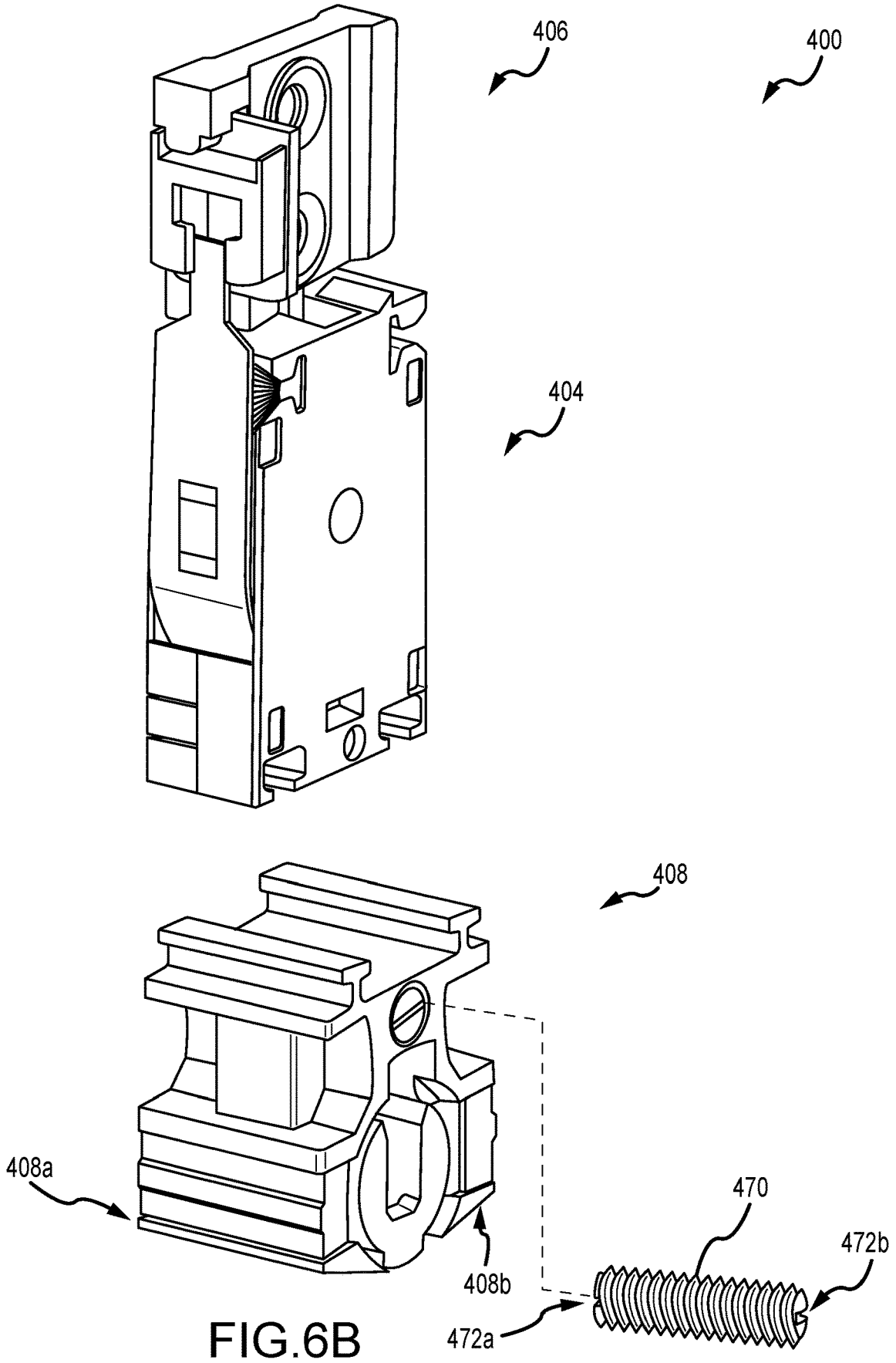
FIG. 6B is a partial exploded perspective view of the inverted constant force window balance of FIG. 6A.

FIG. 6A is a perspective view of another inverted constant force window balance system 400. FIG. 6B is a partial exploded perspective view of the inverted constant force window balance 400 and is described concurrently therewith. A number of features and components of the window balance system 400 are numbered similarly to those of FIGS. 2A-2B and, as such, are not necessarily described further. In the depicted configuration, the window balance system 400 includes a mounting bracket 406 and coil housing 404, both of which are substantially similar to those depicted and described elsewhere herein. Shoe assembly 408, however, incorporates a friction-adjustment system in the form of an adjustable friction screw 470 extending between the first face 408*a* and the second face 408*b*. The friction screw 470 is disposed in an upper portion of the shoe assembly 408, generally where the throat is located in the other embodiments depicted herein. The friction screw 470 includes, at both ends, engagements slots 472*a*, 472*b*. The engagement slots 472*a*, 472*b* are configured to receive a screw driver or other adjustment element, which may rotate the screw 470. Since engagement slots 472*a*, 472*b* are located on both ends of the friction screw 470, the friction screw 470 may be adjusted regardless of the window jamb in which the window balance system 400 installed. Appropriate rotation of the friction screw 470 causes at least a portion of the screw to project beyond the face of the shoe assembly 408 that slides along the rear wall of the jamb channel. This causes the opposite face to increase frictional contact with the two front walls of the jamb channel. This increase in friction may be advantageous to modify the performance of the window balance system 400. In an example, the screw 470 rotates about an axis that is substantially orthogonal to the faces 408*a*, 408*b* of the shoe assembly 408.

Figure 7:
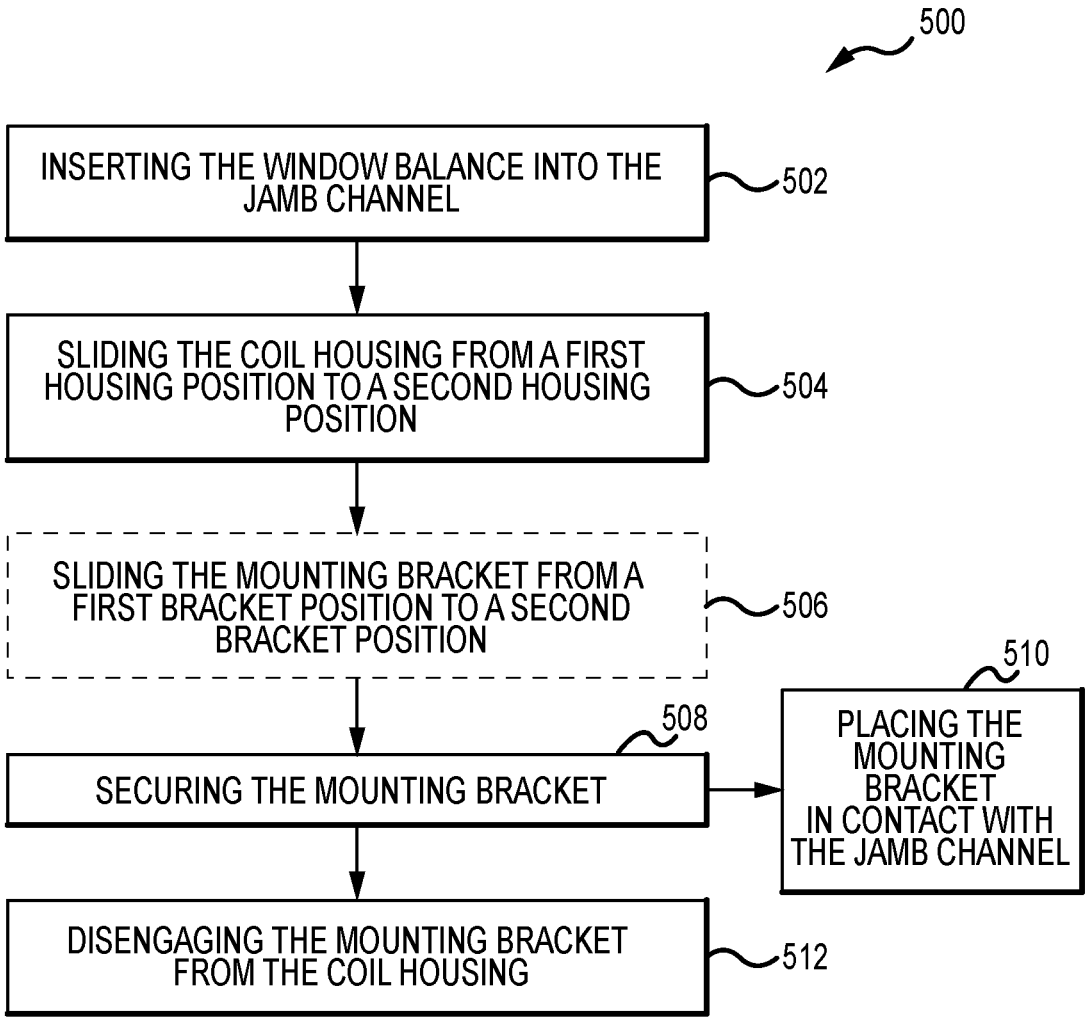
FIG. 7 is a flowchart illustrating an exemplary method of installing a window balance system.

FIG. 7 is a flowchart illustrating an exemplary method 500 of installing a window balance system in a window jamb channel. In this example, the window balance system may be an inverted constant force window balance system including a mounting bracket, a coil housing, a coil spring, and a shoe assembly. Examples thereof are depicted and described herein. The method 500 begins with operation 502, inserting the window balance system into the window jamb channel. Of course, most windows include two window jambs and would therefor require two window balance systems. In the context of FIG. 7, however, the method 500 of installing a single window balance system is described. Flow continues to operation 504, sliding the coil housing from a first housing position to a second housing position.

This sliding operation 504 is substantially orthogonal to a direction of travel of the window sash and window balance when the sash is being opened or closed. Further, the sliding operation 504 is orthogonal to the rear wall of a window jamb. Optional operation 506 includes sliding the mounting bracket from a first bracket position to a second bracket position. This operation 506 may be considered optional because in certain insertion orientations, the mounting bracket may be disposed on a side of the coil housing that places the mounting bracket proximate the rear wall of the jamb channel due simply to the sliding operation 504. Such installation orientations are depicted above, e.g., in FIGS. 3A and 3B. In the second bracket position, a side of the mounting bracket is substantially coplanar with a wall of the coil housing proximate to and generally in contact with the rear wall of the jamb channel. Securing of the mounting bracket to the window jamb occurs at operation 508, and may be performed by inserting a fastener of some type through at least a portion of the mounting bracket. In an example, securing the mounting bracket includes also operation 510, placing the mounting bracket in contact with the jamb channel. In examples, operations 508 and 510 may be performed substantially simultaneously. Such simultaneous performance may occur, for example, when the window balance system is installed in the configuration such as depicted in FIG. 4A. The method 500 concludes with disengaging the mounting bracket from the coil housing, operation 512. In examples, operation 512 may be performed substantially simultaneously with operation 510.

The materials utilized in the engagement systems described herein may be those typically utilized for window and window component manufacture. Material selection for most of the components may be based on the proposed use of the window. Appropriate materials may be selected for the sash retention systems used on particularly heavy window panels, as well as on windows subject to certain environmental conditions (e.g., moisture, corrosive atmospheres, etc.). Aluminum, steel, stainless steel, zinc, or composite materials can be utilized (e.g., for the coil spring mount body to prevent separation with the coil spring). Bendable and/or moldable plastics may be particularly useful. For example, the housing and/or the mounting bracket may be unitarily formed with the engagement member and/or the receiving member. While in other examples, the engagement member and/or receiving member may couple to the housing and/or mounting bracket as an accessory for the window balance system.

Any number of the features of the different examples described herein may be combined into one single example and alternate examples having fewer than or more than all of the features herein described are possible. It is to be understood that terminology employed herein is used for the purpose of describing particular examples only and is not intended to be limiting. It must be noted that, as used in this specification, the singular forms "a," "an," and "the" include plural referents unless the context clearly dictates otherwise.

While there have been described herein what are to be considered exemplary and preferred examples of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. An inverted constant force window balance system comprising:

a carrier assembly comprising:

a housing comprising a first housing wall and a second housing wall substantially parallel to the first housing wall;

a coil spring disposed within the housing, the coil spring comprising a free end; and a shoe assembly slidably coupled to the housing, wherein the shoe assembly comprises a first shoe face and a second shoe face substantially parallel to the first shoe face, wherein the housing is configured to slide between a first position and a second position relative to the shoe assembly, wherein when in the first position, the first housing wall and the second housing wall are substantially non-coplanar with the first shoe face, wherein when in the second position, the first housing wall is substantially coplanar with the first shoe face and substantially non-coplanar with the second shoe face, and wherein the shoe assembly is configured to receive a pivot bar from a window sash and extend at least one brake upon rotation of the pivot bar; and a mounting bracket releasably coupled to the housing opposite the shoe assembly and coupled to the free end of the coil spring.

2. The inverted constant force window balance system of claim 1, wherein at least a portion of the mounting bracket is configured to slideably move in relation to the free end of the coil spring between at least two mounting bracket positions, and wherein when at least a portion of the mounting bracket moves between the at least two mounting bracket positions, the mounting bracket disengages from the housing.

3. The inverted constant force window balance system of claim 2, wherein the mounting bracket comprises a jamb mount and a coil spring mount, wherein the jamb mount is configured to slide in relation to the coil spring mount between a first jamb mount position and a second jamb mount position, wherein when in the first jamb mount position, the jamb mount is releasably engaged with the housing, and wherein when in the second jamb mount position, the jamb mount is disengaged from the housing.

4. The inverted constant force window balance system of claim 1, wherein the shoe assembly comprises a shoe housing comprising a first leg and a second leg, wherein the first leg and the second leg are separated by and at least partially define a throat.

5. The inverted constant force window balance system of claim 4, wherein when the housings is in the second position, a portion of the throat proximate the second shoe face is configured to receive a pivot bar in a pivot bar insertion direction substantially parallel to the second housing wall.

6. The inverted constant force window balance system of claim 4, wherein the shoe assembly further comprises a rotatable cam disposed at a lower portion of the throat.

7. The inverted constant force window balance system of claim 6, wherein the rotatable cam defines a keyhole, and wherein in a first rotated position, the keyhole is in communication with the throat, and in a second rotated position, the keyhole is not in communication with the throat.

8. The inverted constant force window balance system of claim 1, wherein the shoe assembly comprises a friction screw extending from the first shoe face to the second shoe face.

9. The inverted constant force window balance system of claim 8, wherein the friction screw defines, at each end, an engagement slot.

10. The inverted constant force window balance system of claim 1, wherein the housing is configured to slide between the first position and a third position relative to the shoe assembly, and wherein when in the third position, the second housing wall is substantially coplanar with the second shoe face and substantially non-coplanar with the first shoe face.

11. The inverted constant force window balance system of claim 1, further comprising a friction screw extending from the first shoe face to the second shoe face, wherein the friction screw defines, at each end, an engagement slot.

12. The inverted constant force window balance system of claim 1, wherein the housing is detachably connected to the shoe assembly.

* * * * *